US008428446B1

(12) United States Patent
Pimentel

(10) Patent No.: US 8,428,446 B1
(45) Date of Patent: Apr. 23, 2013

(54) SNOW AND ICE MELTING DEVICE

(76) Inventor: Mike Pimentel, Whiting, IN (US)

( * ) Notice: Subject to any disclaimer, the term of this patent is extended or adjusted under 35 U.S.C. 154(b) by 656 days.

(21) Appl. No.: 12/626,588

(22) Filed: Nov. 25, 2009

(51) Int. Cl.
*A45D 20/10* (2006.01)

(52) U.S. Cl.
USPC ..... 392/383; 392/379; 392/384

(58) Field of Classification Search ..... None
See application file for complete search history.

(56) References Cited

U.S. PATENT DOCUMENTS

| | | | | |
|---|---|---|---|---|
| 2,820,450 | A | 1/1958 | Zimmerman | |
| 3,400,244 | A * | 9/1968 | Meltzer | 219/228 |
| 3,471,681 | A * | 10/1969 | Miller | 392/379 |
| 5,140,762 | A | 8/1992 | Monson | |
| 5,867,926 | A | 2/1999 | Schmitt | |
| 5,948,299 | A * | 9/1999 | Scalia | 219/228 |
| 6,455,812 | B1 * | 9/2002 | Houle | 219/228 |
| 6,595,200 | B1 | 7/2003 | Dai | |
| 7,059,071 | B2 | 6/2006 | Hanafusa et al. | |
| D554,155 | S | 10/2007 | Yuzuriha | |
| 2006/0083493 | A1 * | 4/2006 | Dolton, III | 392/384 |
| 2012/0006804 | A1 * | 1/2012 | Jenkins | 219/202 |

* cited by examiner

*Primary Examiner* — Thor Campbell
(74) *Attorney, Agent, or Firm* — Kyle Fletcher

(57) ABSTRACT

The snow and ice melting device consists of a power generator contained within a housing, which includes wheels and a handle to make mobile. A heater deck is suspended above the ground in front of the housing, and includes a heating element and a blower, which directs heated air towards the ground in order to melt snow or ice. The heater deck is connected to the housing by a pivoting arm and a winch cable that enables the heater deck to hover above the ground or to fold vertically next to the housing when not in use.

17 Claims, 6 Drawing Sheets

SNOW AND ICE MELTING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of snow and ice melting mechanisms, more specifically, a portable heat generator that is both mobile and specifically designed to melt snow or ice from the ground.

B. Discussion of the Prior Art

As a preliminary note, it should be stated that there is an ample amount of prior art that deals with snow and ice melting apparatuses. As will be discussed immediately below, no prior art discloses a device that is easily movable, and of which includes portable heat generating means therein, which are directed to melting snow and ice on the ground.

The Schmitt Patent (U.S. Pat. No. 5,867,926) discloses a portable ice and snow-melting machine that directs heated air with a blower onto the surface of the ground. However, the machine is not remotely powered via a generator, and of which includes a heater deck extends in front of the machine and further includes a heating element suspended below a blower.

The Monson Patent (U.S. Pat. No. 5,140,762) discloses a generator and motor mounted on a wheeled cart with a handle for pushing the machine and which has a blower device for directing heated exhaust on the ground for melting snow and ice on a sidewalk, driveway, or roadway. However, the snow melting heater deck does not have an automated deck winch assembly for raising and lowering the heater deck from above the ground to an upright position.

The Zimmerman Patent (U.S. Pat. No. 2,820,450) discloses a walk behind portable snow and ice melting machine. However, the machine does not have a heater deck that extends in front of the portable power generator, and of which said heater deck can be winched up or down via an automated deck winch assembly.

The Dai Patent (U.S. Pat. No. 6,595,200) discloses a mobile device using heated air for melting snow and ice, which is pushed by a person. However, the mobile device does not include a heater deck that is suspended above the ground and of which directs heated air down to the ground below in order to melt snow or ice.

The Patent (U.S. Pat. No. 7,059,071) discloses a walk behind snowplow and ice melting machine that directs heated air by blower onto the snowplow augers. However, the device is not directed to simply melting snow and ice, but rather is directed to heating a snowplow auger.

The Yuzuriha Patent (U.S. Pat. No. Des. 554,155) illustrates a design for a walk behind snowplow and melting machine, which does not depict a heater deck that directs heated air downwardly in order to melt snow or ice on the ground.

While the above-described devices fulfill their respective and particular objects and requirements, they do not describe a snow and ice melting device, which consists of a portable power generator that includes a heater deck suspended above the ground and forward of the generator, and of which the heater deck can be raised or lowered via an automated winch assembly. In this regard, the snow and ice melting device departs from the conventional concepts and designs of the prior art.

BRIEF SUMMARY OF THE INVENTION

The snow and ice melting device consists of a power generator contained within a housing, which includes wheels and a handle to make mobile. A heater deck is suspended above the ground in front of the housing, and includes a heating element and a blower, which directs heated air towards the ground in order to melt snow or ice. The heater deck is connected to the housing by a pivoting arm and a winch cable that enables the heater deck to hover above the ground or to fold vertically next to the housing when not in use.

An object of the invention is to provide a portable ice and snow melting device that is remotely operated and powered.

A further object of the invention is to provide a heater deck that can be suspended above the ground or folded horizontally adjacent to the housing when not in use.

A further object of the invention is to provide a heater deck that directs heated air downwards towards the ground.

A further object of the invention is to provide a device that has wheels and is manually pushed via a handle.

A further object of the invention is to include a plurality of metal plates that are mounted about the periphery of the deck, and of which can be adjusted up or down to provide a more contained seal between the deck and the surface to be heated.

These together with additional objects, features and advantages of the snow and ice melting device will be readily apparent to those of ordinary skill in the art upon reading the following detailed description of presently preferred, but nonetheless illustrative, embodiments of the snow and ice melting device when taken in conjunction with the accompanying drawings.

In this respect, before explaining the current embodiments of the snow and ice melting device in detail, it is to be understood that the snow and ice melting device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the snow and ice melting device.

It is therefore important that the claims be regarded as including such equivalent construction insofar as they do not depart from the spirit and scope of the snow and ice melting device. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
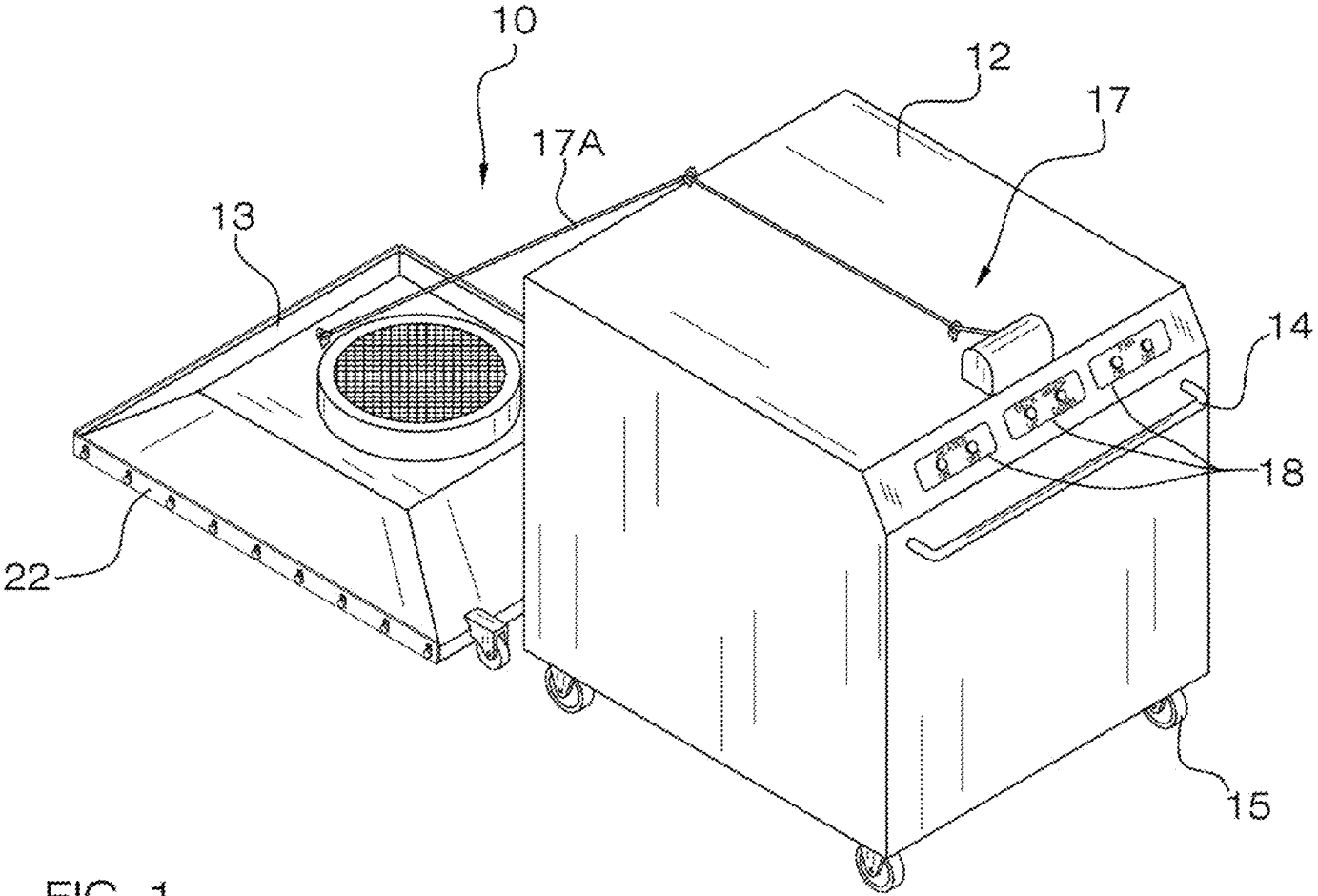
FIG. 1 illustrates an isometric view of the snow and ice melting device with the heater deck suspended above the ground and in front of the housing.
Figure 2:
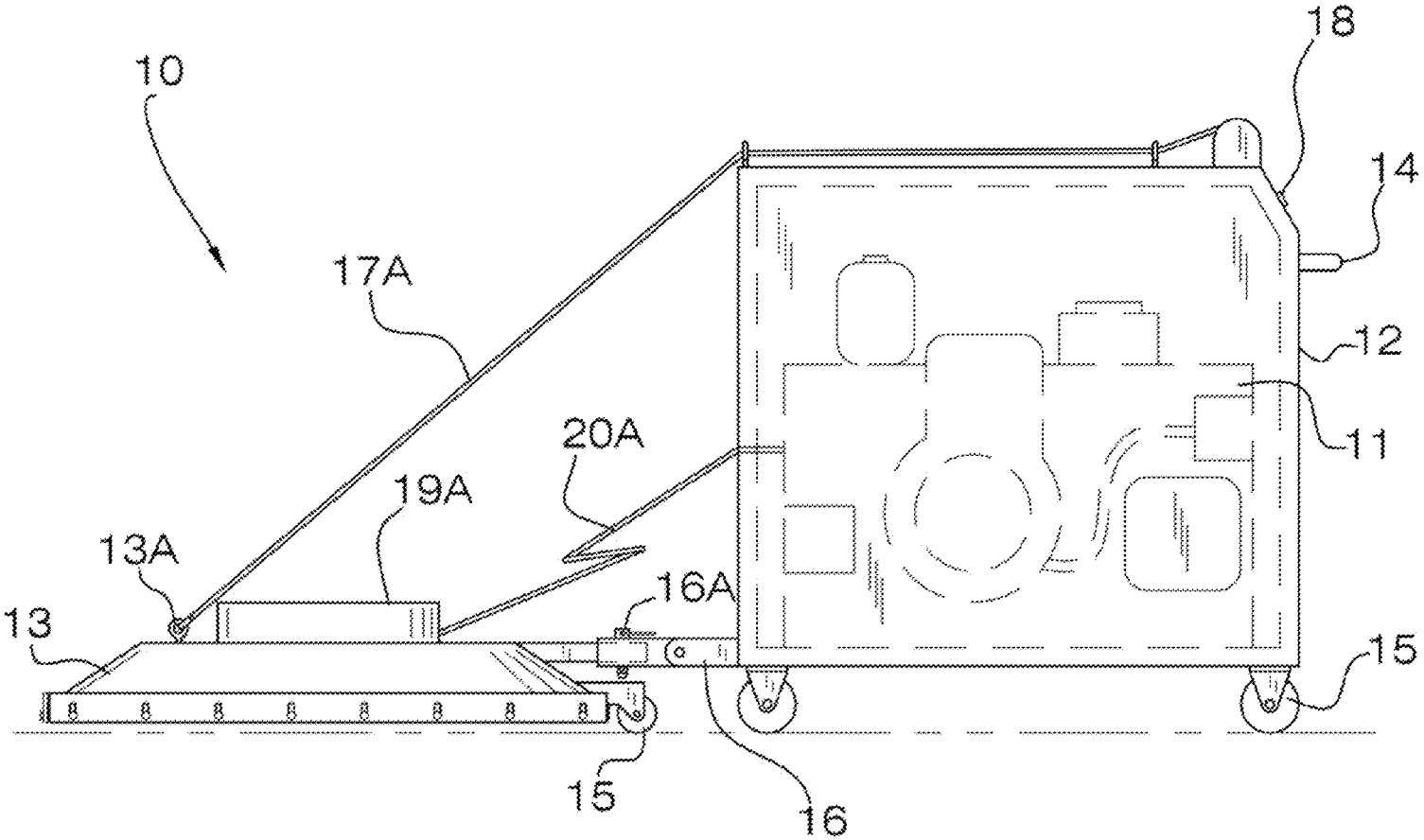
FIG. 2 illustrates a side view of the snow and ice melting device with hidden lines depicting the power generator included within the housing as well as the heater deck suspended above the ground.
Figure 3:
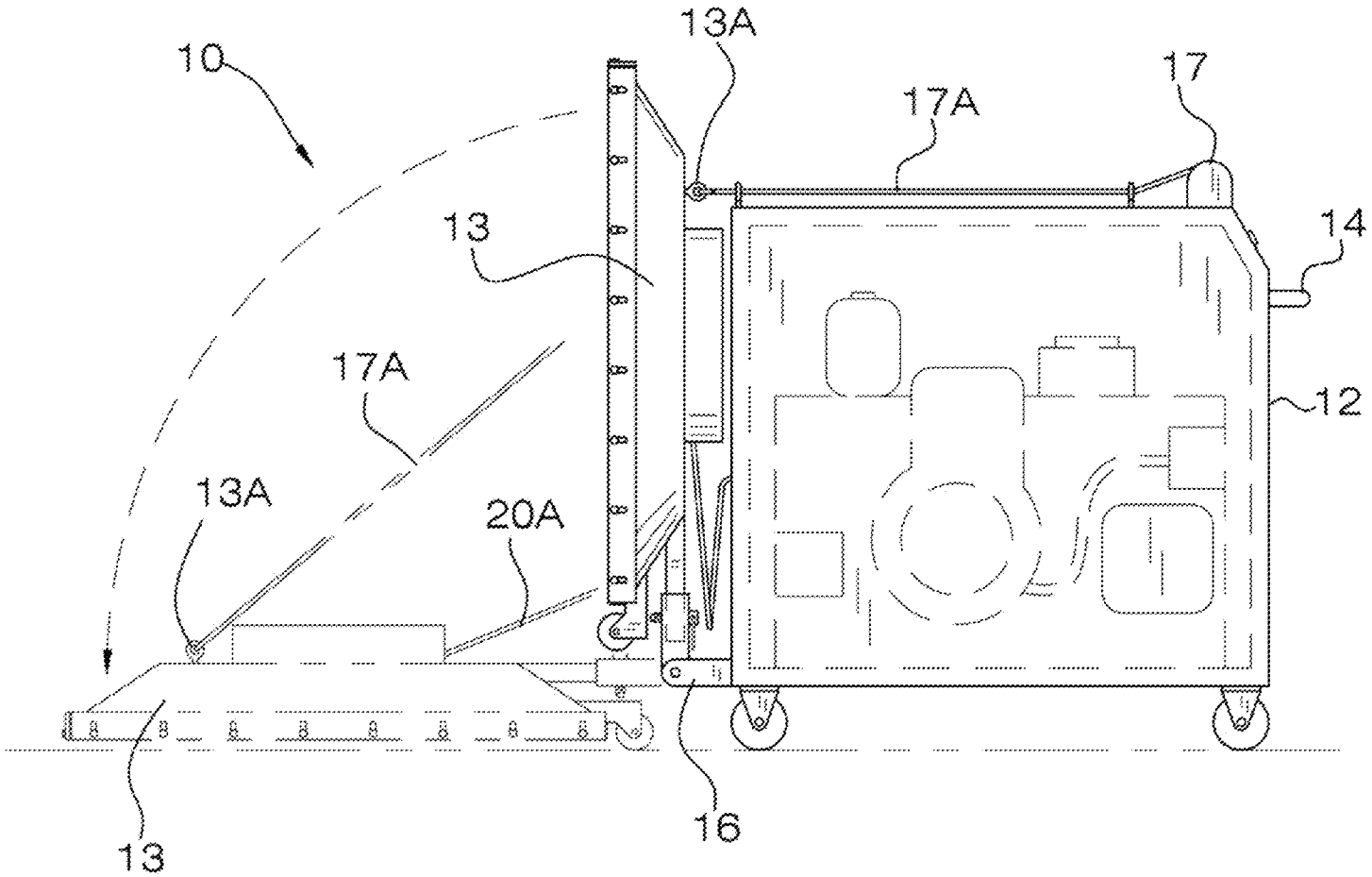
FIG. 3 illustrates a side view of the snow and ice melting device with a rotational arrow indicating rotational movement of the heater deck from a vertical position to a horizontal position as in being suspended above the ground.
Figure 4:
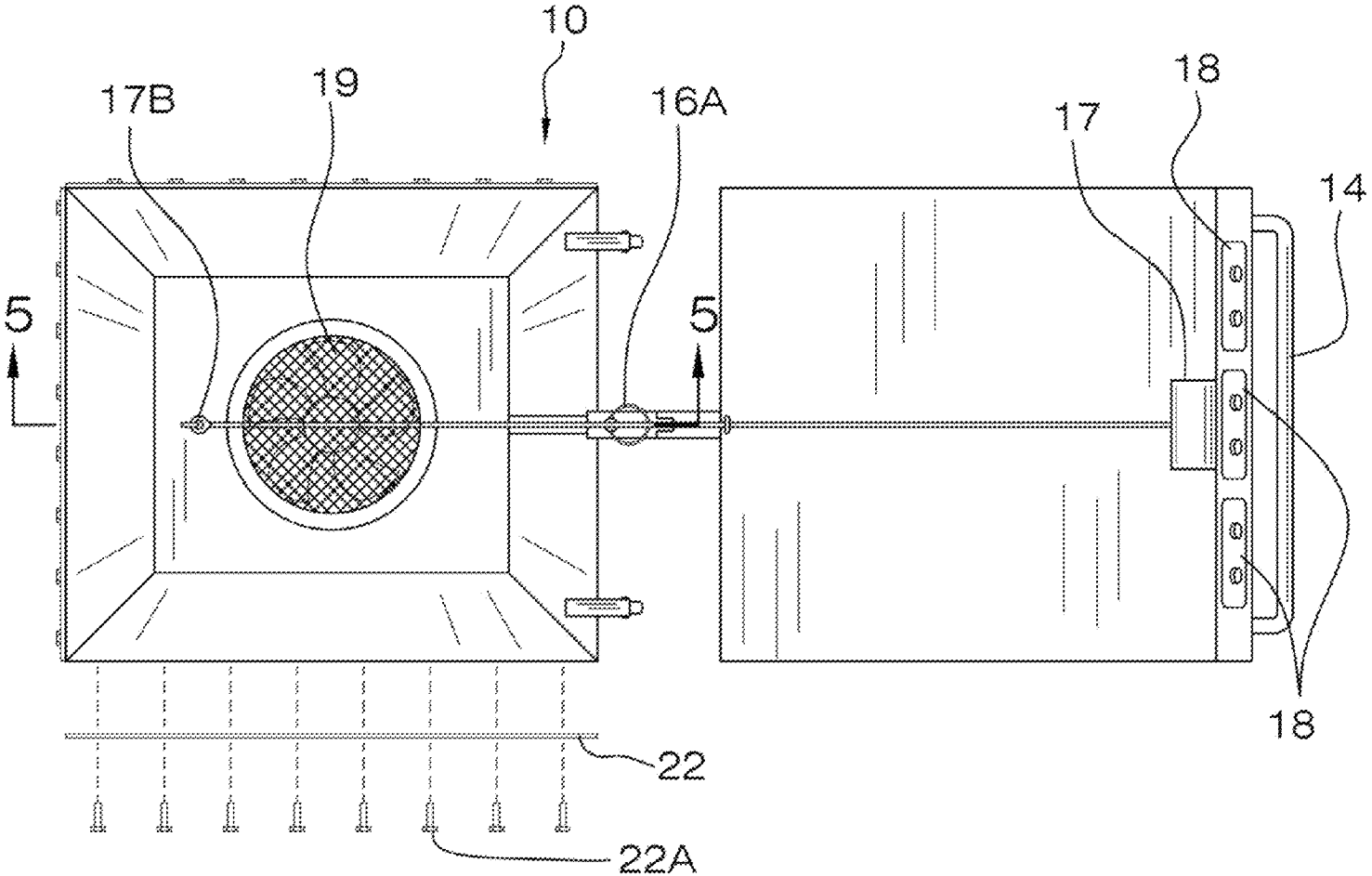
FIG. 4 illustrates a top view of the snow and ice melting device with the heater deck suspended above the ground with a metal plate and bolts exploded from one side of the deck.

Detailed reference will now be made to the preferred embodiment of the present invention, examples of which are illustrated in FIGS. 1-6. A snow and ice melting device 10 (hereinafter invention) includes a power generating means 11, a housing 12, a heater deck 13, a handle 14, a plurality of wheels 15, a pivoting arm 16, an automated winch assembly 17, controls 18, a blower 19, and a heating element 20.

The power generating means 11 consists of a portable electric generator that burns a hydrocarbon fuel via an internal combustion engine.

The power generating means 11 is contained within the housing 12. The housing 12 has a plurality of wheels 15 to provide mobility to the invention 10. The heater deck 13 (as depicted) include wheels 15 to assist in the movement of the invention 10.

The heater deck 13 contains the blower 19 and the heating element 20. The heating element 20 is suspended below the blower 19, such that air is forced down from the blower 19, across the heating element 20 where the heated air impacts the ground, and thus melts ice or snow contained thereon. The heater deck 13 includes an air inlet 19A that is positioned above the blower 19 and enables air to pass into the heater deck 13 and across the blower 19. The heating element 20 traverses horizontally across the interior of the heater deck 13, and the heating element 20 is suspended above the ground via a plurality of brackets 21 that attach at predetermined points along both the heating element 20 as well as the interior surface of the heater deck 13.

The heater deck 13 connects to the power generating means 11 or housing 12 via the pivoting arm 16. The pivoting arm 16 enables rotational movement of the heater deck 13 with respect to the housing 12. The heater deck 13 can be suspended above the ground or folded vertically and adjacent to the housing 12 when not in use. The pivoting arm 16 may include a pin 16A, which enables the heater deck 13 to detach from the power generating means 11 or housing 12.

The automated winch assembly 17 consists of a winch cable 17A and a motor (not depicted). The motor will let out or reel in the winch cable 17A in order to rotate the heater deck 13 to a desired position. The winch cable 17A has a clip 17B that connects to an eyelet 13A located on the heater deck 13. The clip 17B can be detached from the eyelet 13A should it be desirable to detach the heater deck 13 from the housing 11. A control(s) 18 are provided to operate the automated winch assembly 17.

Controls 18 are provided to operate the blower 19 and heating element 20, independently. A power line 20A connects the power generating means 11 to both the blower 19 and heating element 20.

Figure 5:
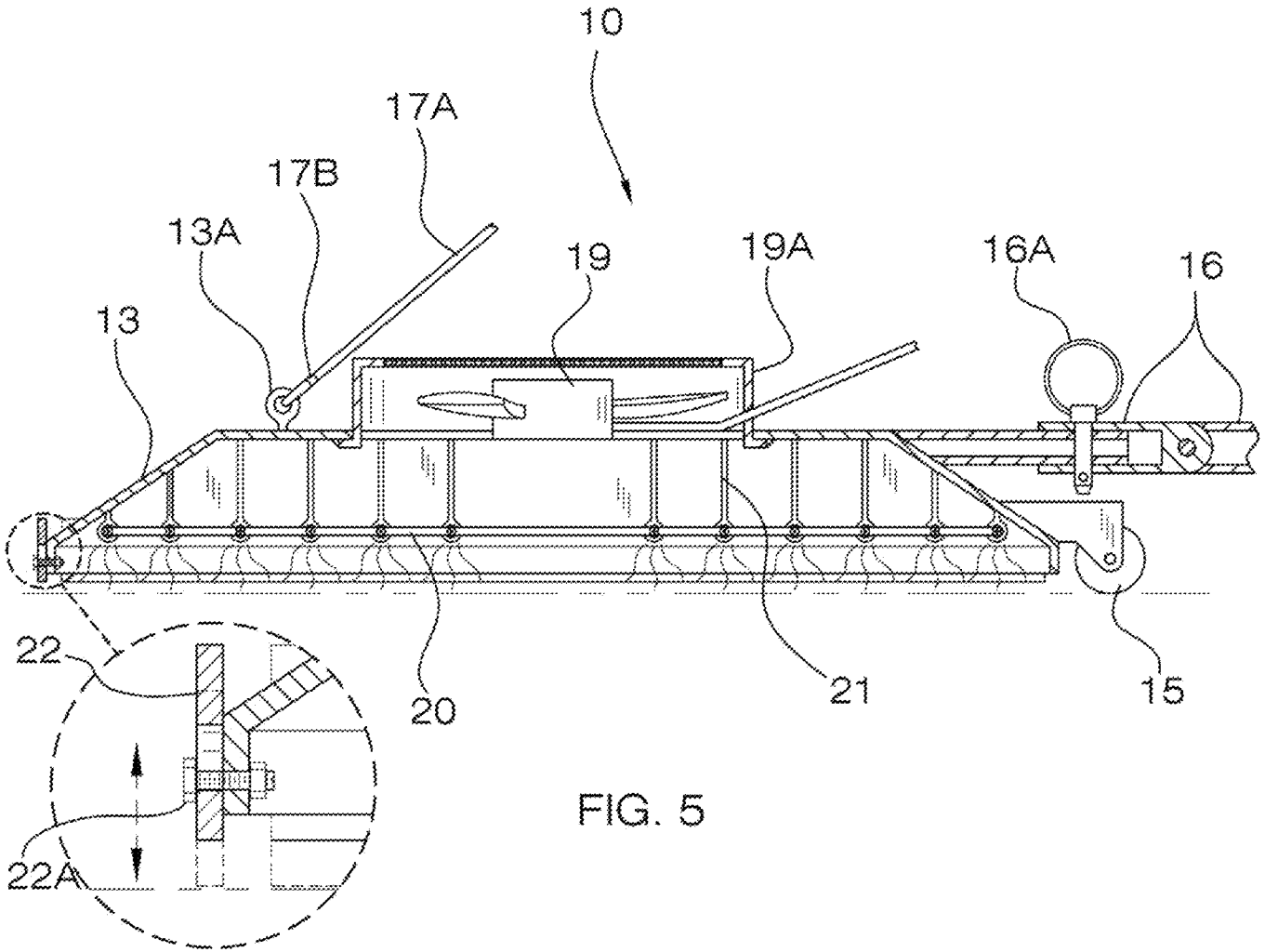
FIG. 5 illustrates a cross-sectional view of the snow and ice melting device along line 5-5 in FIG. 4 with wavy lines indicating heated air traveling from the heating element to the ground via the blower located above the heating element, as well as detail regarding the metal plates about the periphery of the deck and detailing how the height of said plates can be adjusted up or down relative to the ground to be heated.
Figure 6:
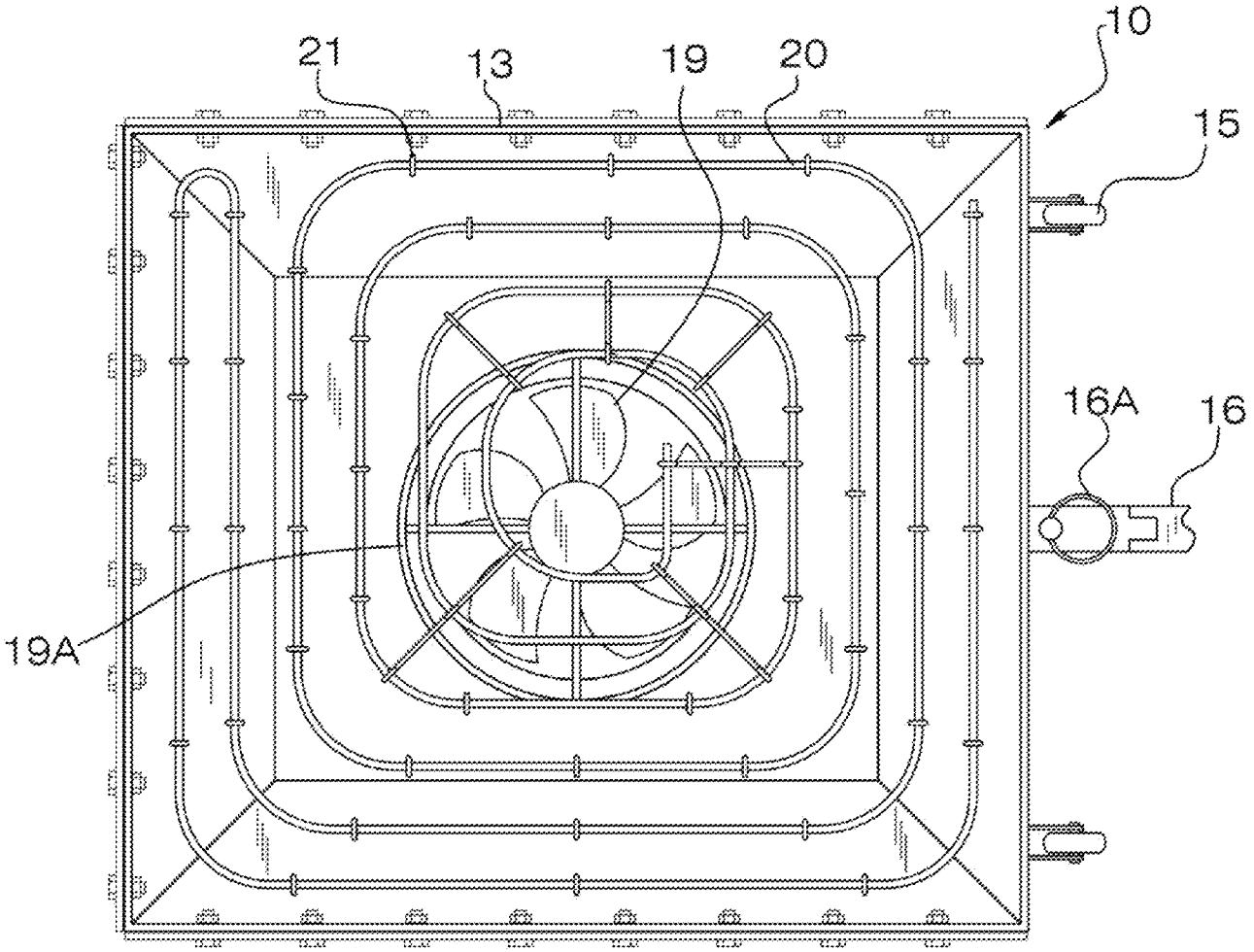
FIG. 6 illustrates a bottom view of the heater deck and detailing the heating element and blower contained within the heater deck.

Attached about a perimeter of the heater deck 13 is a plurality of metal plates 22. The metal plates 22 attach to the heater deck 13 via a plurality of bolts 22A. Referring to FIG. 5, the metal plates 22 can be adjusted up or down with respect to the heater deck 13 in order to provide a smaller gap between the heater deck 13 and the ground to be heated by the invention 10. The inclusion of the metal plates 22 improves the overall efficiency of the invention 10 by limiting the amount of heat that escapes from the sides of the heater deck 13.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A snow and ice melting device comprising:

a portable electric generator that has a plurality of wheels for mobility, a heater deck extends from the portable electric generator and further includes a heating element and blower to direct heated air towards the ground;

wherein a plurality of metal plates attach along an outer perimeter of the heater deck near a bottom edge via a plurality of bolts, which enable the metal plates to be raised or lowered with respect to said heater deck in order to minimize the clearance between the heater deck and the ground for preventing heat from escaping along said bottom edge.

2. The snow and ice melting device as described in claim 1 wherein the heater deck attaches to the portable electric generator via a pivoting arm.

3. The snow and ice melting device as described in claim 2 wherein an automated winch assembly connects the heater deck to the portable electric generator, and thus enables the heater deck to lay horizontally in a state suspended above the ground or to fold vertically when not in use.

4. The snow and ice melting device as described in claim 3 wherein controls provide for the rotation of the automated winch assembly.

5. The snow and ice melting device as described in claim 2 wherein the pivoting arm includes a pin that can be removed to separate the heater deck from the portable electric generator.

6. The snow and ice melting device as described in claim 1 wherein the portable electric generator is contained within a housing.

7. The snow and ice melting device as described in claim 1 wherein a handle attaches to the portable electric generator and assists in the movement of the device across grounds covered with ice or snow.

8. The snow and ice melting device as described in claim 1 wherein controls provide for operating the blower.

9. The snow and ice melting device as described in claim 1 wherein controls provide for operating the heating element.

10. A snow and ice melting device comprising:

a portable electric generator that is contained within a housing; wherein said housing has a plurality of wheels for mobility; wherein a heater deck extends from said housing and further includes a heating element and blower to direct heated air towards the ground;

wherein a plurality of metal plates attach along an outer perimeter of the heater deck near a bottom edge via a plurality of bolts, which enable the metal plates to be raised or lowered with respect to said heater deck in order to minimize the clearance between the heater deck and the ground for preventing heat from escaping along said bottom edge.

11. The snow and ice melting device as described in claim 10 wherein the heater deck attaches to the housing via a pivoting arm.

12. The snow and ice melting device as described in claim 11 wherein an automated winch assembly connects the heater deck to the housing, and thus enables the heater deck to lay horizontally in a state suspended above the ground or to fold vertically when not in use.

13. The snow and ice melting device as described in claim 12 wherein controls provide for the rotation of the automated winch assembly.

14. The snow and ice melting device as described in claim 11 wherein the pivoting arm includes a pin that can be removed to separate the heat deck from the housing.

15. The snow and ice melting device as described in claim 10 wherein a handle attaches to the housing and assists in the movement of the device across grounds covered with ice or snow.

16. The snow and ice melting device as described in claim 10 wherein controls provide for operating the blower.

17. The snow and ice melting device as described in claim 10 wherein controls provide for operating the heating element.

* * * * *